United States Patent [19]

Obey

[11] Patent Number: 4,492,132

[45] Date of Patent: Jan. 8, 1985

[54] LID REMOVAL TOOL

[76] Inventor: Richard P. Obey, 5 Warden St., Apt. 6, Saugus, Mass. 01906

[21] Appl. No.: 500,929

[22] Filed: Jun. 3, 1983

[51] Int. Cl.[3] ..... B67B 7/00

[52] U.S. Cl. ..... 81/3.1 R; 81/3.46 R; 7/151; 30/2

[58] Field of Search ..... 81/3.1 R, 3.34, 3.36, 81/3.46 A, 3.46 R, 3.1 A; 30/2, 1.5, 410; 7/151, 156

[56] References Cited

U.S. PATENT DOCUMENTS

| | | | |
|---|---|---|---|
| 1,773,362 | 8/1930 | Karl . | |
| 2,553,149 | 5/1951 | Schiffmann | 43/42.06 |
| 2,593,358 | 4/1952 | Sprich | 81/3.46 R |
| 2,669,143 | 2/1954 | Bradbury | 81/3.46 R |
| 2,694,326 | 11/1954 | Lewis | 81/3.46 R |
| 3,872,745 | 3/1975 | Garza et al. | 81/3.46 R |
| 4,234,988 | 11/1980 | Ross et al. | 7/151 |

FOREIGN PATENT DOCUMENTS 2450272 10/1974 Fed. Rep. of Germany .

*Primary Examiner*—Roscoe V. Parker

[57] ABSTRACT

A tool enabling easy removal, without normally experienced difficulties, of relatively rigid, heavy-guage lids of synthetic material, the lid having a top surface and a substantial, downwardly extending rim which ends in a continuous lip, the rim being designed to provide a tight fit on bulk containers, the lid being removable only after the downwardly extending rim lip is cut at spaced apart points about the circumference. The tool has a rigid shaft, one end adapted for use as a handle, and a forked construction at the other end defining two arms configured and arranged to engage about the lid rim. The first arm has at its outer end a portion shaped to rest on the top surface of the lid adapted to serve as a fulcrum during lid removal. The second arm has at its end a rim-gripping formation shaped to grip the rim lip and an upwardly directed cutting edge adapted to move upwardly during inward rotation of the handle in a manner to progressively cut the lip and locally sever the rim, the rim-gripping formation adapted to engage and pull the rim upwardly during handle rotation.

6 Claims, 6 Drawing Figures

FIG. 1
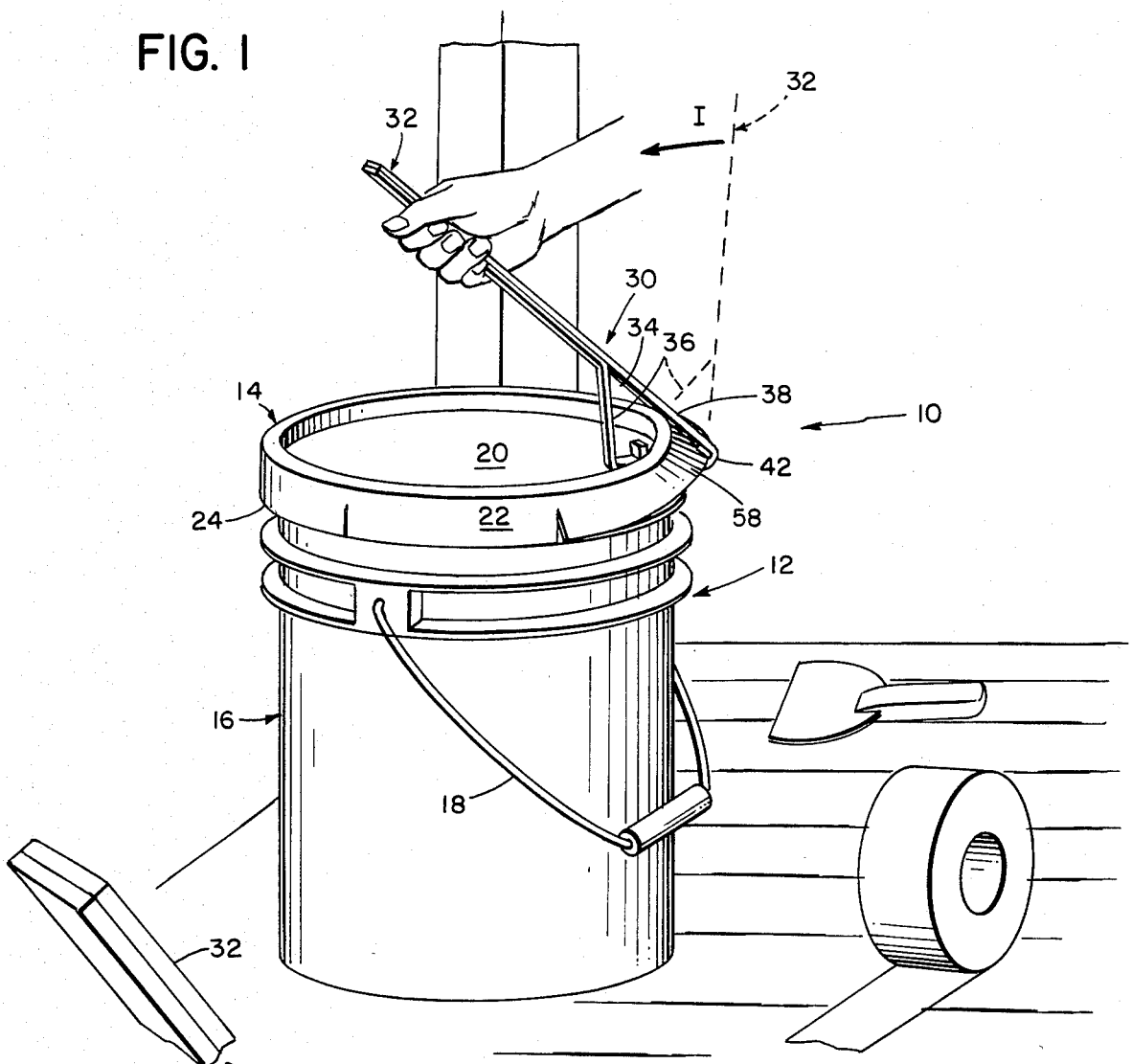
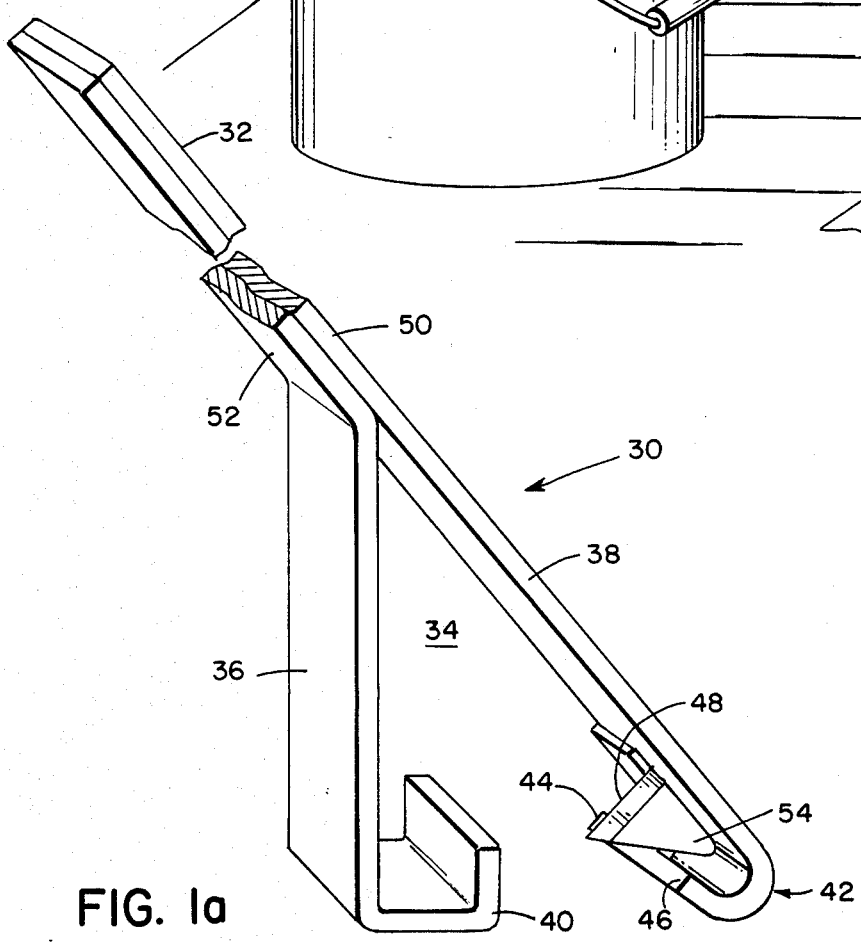
FIG. 1a

LID REMOVAL TOOL

BACKGROUND OF THE INVENTION

The invention relates to tools for removing lids from bulk container drums.

Drums made of synthetic material, e.g. plastic, are the standard containers for providing bulk quantities of materials which have the characteristic of drying out upon prolonged exposure to the atmosphere. A typical example is wallboard compound, supplied in a 62 pound drum.

The drums have rigid, tight fitting lids with a flat top surface and a downwardly extending rim of significant width. The inner surface of the rim typically has an annular rib which engages in sealing contact with an annular rib on the outside of the drum. The lid is applied to the drum at the factory by a mechanical press exterting equal downward force around the top of the rim to force the rim rib over the drum rib. The lid can only be removed by prying the stiff rim outward to allow the rim rib to pass over the drum rib, and this is only possible after the rim has been severed from the lip upward at a number of points, typically six or more, about the rim. After the lip and rim are severed, the lid can be removed by working around the rim, usually a number of times around, prying upward at each now separate section of rim to work the lid off the drum. Any prying tool can be employed, although a screwdriver is typical and most usually available.

When work is complete, the lid is replaced on the drum and pressure applied, e.g. by leaning on the lid, to reengage the drum and rim ribs about the circumference to reestablish sealing contact to prevent drying.

SUMMARY OF THE INVENTION

According to the invention, a tool enabling easy removal, without normally experienced difficulties, of relatively rigid, heavy-gauge lids of synthetic material, of the type having a top surface and a substantial, downwardly extending rim which ends in continuous lip, the rim designed to provide a tight fit on bulk containers, the lid being removeable only after the downwardly extending lip of the rim is cut at spaced apart points about the circumference, comprises a rigid shaft, one end of the shaft adapted for use as a handle, and a forked construction at the other end of the shaft defining two arms configured and arranged to engage about the lid rim, the first arm having at its outer end a portion shaped to rest on the top surface of the lid and adapted to serve as a fulcrum during removal of the lid, the second arm having at its end a rim-gripping formation shaped to grip the lip of the downwardly extendng rim, and an upwardly directed cutting edge adapted to move upwardly during inward rotation of the handle in a manner to progressively cut the lip and locally sever the rim, the rim-gripping formation adapted to engage and pull the rim upwardly during rotation of the handle, whereby to remove the lid, at several points spaced around the circumference of the rim, the tool can be engaged about the rim, the end portion of the first arm resting on the top surface of the lid, the end portion of the second arm positioned to grip the lip, and the cutting edge engaged on the lip, and the handle portion of the tool can be moved inwardly rotating about the fulcrum to cause the cutting edge to cut the lip and locally sever the rim and to cause the end portion of the second arm to grip the lip of the rim and pry it outward and upward to facilitate removal of the lid.

In preferred embodiments, the rim-gripping formation at the outer end of the second arm is a U-shape structure defining an upwardly directed aperture disposed and adapted to receive and to grip the downwardly extending lip and rim of the lid, the portion of the U-shape structure disposed to the inside of the second arm in a direction closer to the first arm extending above the base of the U-shape structure to a substantial height sufficient to confine the rim within the formation during inward rotation of the handle of the tool, and the upwardly directed cutting edge of the tool is disposed on a cutting blade positioned across the aperture of the U-shape structure, whereby during inward rotation of the handle portion of the tool about the fulcrum, the cutting edge of the tool is caused to cut through the lip and to pass upwardly to locally sever the rim, a segment of the rim adjacent the cut being caused to pass beside the blade into a confined, gripped relationship with the formation, further rotation of the handle causing the formation to pull the rim portion contiguous with the gripped segment over a substantial arc upward and outward to facilitate removal of the lid, preferably the cutting edge is upwardly disposed across the aperture of the U-shape structure in a manner whereby during inward rotation of the handle of the tool, adjacent portions of the rim about the point of cutting are simultaneously gripped and adjacent contiguous portions of the rim over a substantial arc are pulled outward and upward by the tool; the first arm lies at an obtuse angle to the shaft, preferably the angle is between about 120° and 160°; and the second arm is substantially colinear with said rigid shaft.

PREFERRED EMBODIMENT

The structure and operation of a preferred embodiment of the invention will now be described, after describing the drawings.

DRAWINGS

FIG. 1 is a prospective view of the tool being used to open a drum of wallboard compound;

FIG. 1*a* is an enlarged prospective view of the tool showing the forked arm construction;

STRUCTURE

Figure 2:
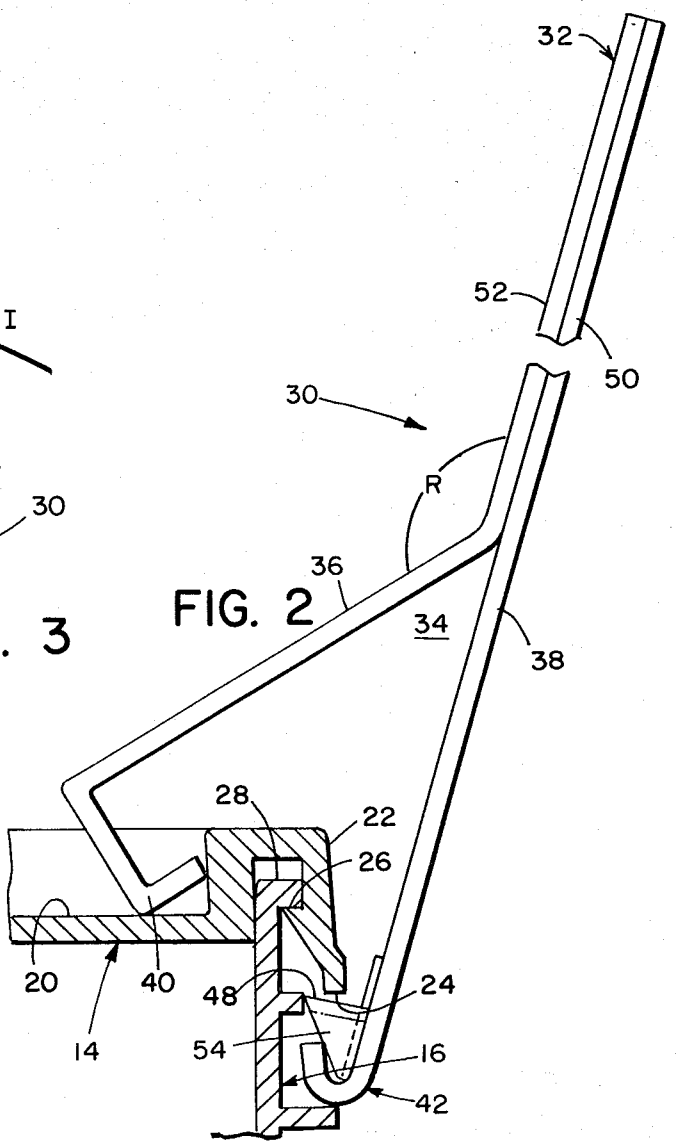
FIG. 2 is a side view partially in section of the tool with the arms being engaged about the drum lid rim.

Referring to FIG. 1, a worksite 10 is pictured. Bulk container 12 of wallboard compound is shown as received at the worksite, with the rigid heavy, gauge lid 14 in place sealing the container contents against prolonged drying-exposure to the atmosphere.

The container 12, typically holding about 62 pounds of compound, includes a molded bucket 16 with a handle 18. The lid 14 has a top surface 20 and a substantial, downwardly extending rim 22 ending in a continuous lip 24.

Referring to FIG. 2, an annular rib 26 on the inner surface of rim 22 engages in sealing contact with outer annular rib 28 on the surface of the bucket 16 when lid 14 is in place to provide a tight, sealing fit. To remove lid 14, the rim 22 must be pried outward to permit the rim annular rib 26 to pass over the drum annular rib 28.

Referring to FIG. 2, and also to FIG. 1*a*, the tool 30 allowing easy removal of lid 14 from drum 12 without normally experienced difficulties comprises a handle 32 and a forked construction 34 defining two arms 36, 38 configured and arranged to engage about lid rim 22.

First arm 36 lying at an obtuse angle R to handle 32, typically at an angle of between about 120° and 160°, has at its outer end a portion 40 shaped and configured to rest on the top surface 20 of the lid 14 and adapted to serve as a fulcrum during lid removal.

Figure 5:
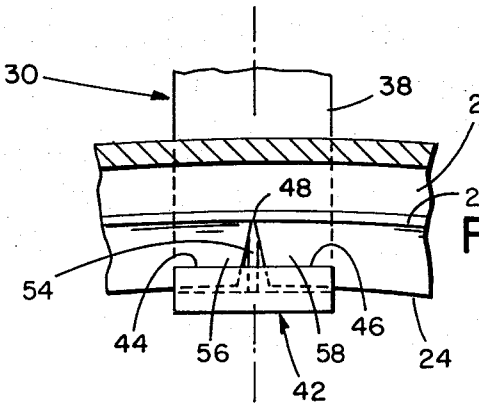
FIG. 5 is a face view taken at the line 5—5 of FIG. 4 showing the lip cut and rim locally severed by the cutting edge with adjacent portions of the rim gripped and pried outward to facilitate removal of the lid.

Second arm 38, typically colinear with handle 32, has at its end a rim-gripping formation 42 of U-shape structure to receive and to grip the downwardly extending lip 24 of rim 22, and between lip gripping portions 44, 46 (see FIG. 5) has an upwardly directed cutting edge 48 disposed on cutting blade 54 positioned across the aperture defined by the structure of rim-gripping formation 42. Cutting edge 48 is adapted to move upward during inward rotaion of handle 32 about the fulcrum.

The tool 30 may be typically manufactured by bending two pieces of cold rolled steel, 50, 52, e.g. $\frac{1}{8}\times 1\times 12$ inch, to the proper form and joining the pieces at handle 32. Cutting blade 54 may be formed of a third piece of cold rolled steel 54, e.g. $1/16\times 1\times 1$ inch, bent and sharpened along edge 48.

Operation

Referring to FIG. 2, tool 30 is brought into use by engaging forked construction 34 about drum rim 22 with the handle 32 at an obtuse angle to lid top surface 20. (Also shown in dashed line in FIG. 1.)

Portion 40 at the outer end of first arm 36 rests on the top surface 20 of lid 14. Rim-gripping formation 42 of second arm 38 lies below rim 22, with cutting edge 48 on blade 54 lying just below or lightly engaged on lip 24 and the aperture defined by the U-shape structure of rim-gripping formations 44, 46 positioned therebelow, not yet engaged.

Figure 3:
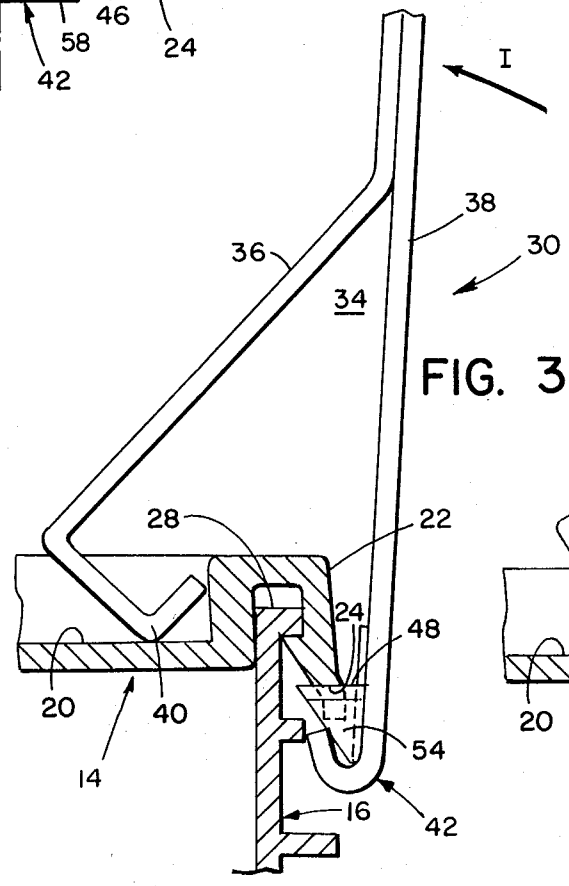
FIG. 3 is a similar view of the tool engaged on the lid to be removed after inward rotation of the tool handle has begun, the cutting edge having cut the rim lip.
Figure 4:
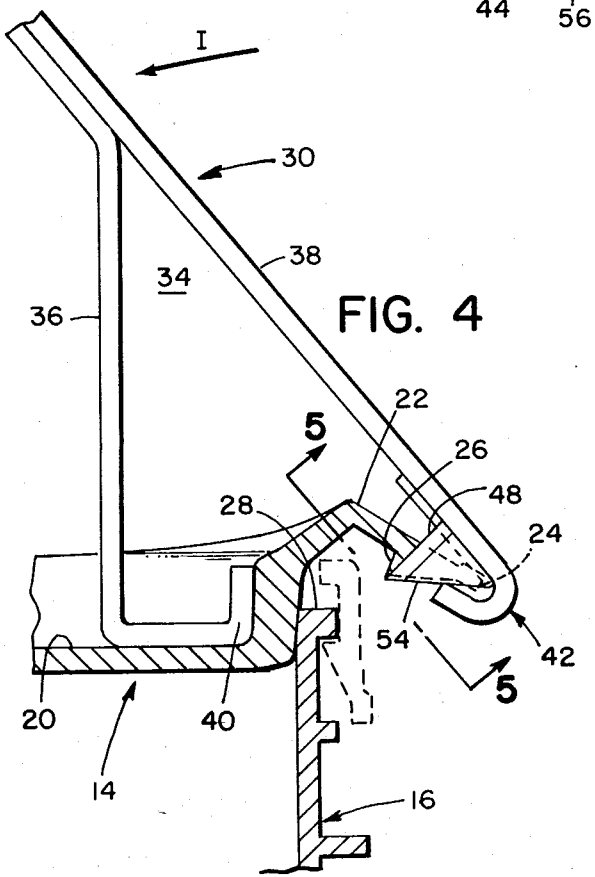
FIG. 4 is a similar view showing operation of the tool, the lip being cut and the rim locally severed, to pry the rim outward for lid removal.

As shown in FIGS. 3 and 4, tool handle 32 is moved inwardly, indicated by arrow I, toward the drum, with the fulcrum engaged on the lid surface 20. This causes rim-gripping formation 42 to move upward to cause cutting edge 48 on blade 54 to cut lip 24 and locally sever rim 22. Segments 56, 58 (FIG. 5) of rim 22 adjacent to blade 54 on both sides of the cut pass along the blade side surfaces into confinement within the U-shape structure of rim-gripping formation 42. Further rotaion of handle 32 inwardly pries gripped rim segments 56, 58 and the contiguous portions of the rim over a substantial arc outward and upward to disengage rim rib 26 from drum rib 28 for lid removal.

This operation is repeated at several points about the rim, as shown in solid line in FIG. 1, three points typically being sufficient for removal of the lid.

When work is completed, lid 14 is again placed on drum 16 and downward pressure applied to reengage opposed ribs 26, 28 for sealing the contents.

Other Embodiments

Other embodiments of the invention are within the following claims, for example the dimensions suggested above are for use the a typical container, however tools of different dimensions, e.g. for use with other size contaners are also contemplated. Also, the tool may be manufactured of other material where desired, e.g. of stainless steel for use in restaurants or other santitary environments.

I claim:

1. For removing relatively rigid, heavy-gauge lids of synthetic material, of the type having a top surface and a substantial, downwardly extending rim which ends in a continuous lip, said rim designed to provide a tight fit on bulk containers, said lid being removable only after the downwardly extending lip of said rim is cut at spaced apart points about the circumference, a tool enabling easy removal of said lid without normally experienced difficulties, said tool comprising a rigid shaft, one end of said shaft adapted for use as a handle, and a forked construction at the other end of said shaft, defining two arms configured and arranged to engage about said rim of said lid, the first arm having at its outer end a portion shaped to rest on the top surface of said lid and adapted to serve as a fulcrum during removal of said lid, the second arm having at its end a rim-gripping formation shaped to grip the lip of said downwardly extending rim, and an upwardly directed cutting edge adapted to move upwardly during inward rotation of said handle in a manner to progressively cut said lip and locally sever said rim, and said rim-gripping formation adapted to engage and pull upwardly said rim during rotation of said handle, whereby to remove said lid, at several points spaced around the circumference of said rim, said tool can be engaged about said rim, the end portion of said first arm resting on the top surface of said lid, the end portion of said second arm positioned to grip said lip and said cutting edge engaged on said lip, and the handle portion of said tool can be moved inwardly rotating about said fulcrum to cause said cutting edge to cut said lip and locally sever said rim and to cause the end portion of the second arm to grip the lip of said rim and pry it outward and upward to facilitate removal of said lid.

2. The tool of claim 1 wherein said rim-gripping formation at the outer end of said second arm is a U-shape structure defining an upwardly directed aperture disposed and adapted to receive and to grip the downwardly extending lip and rim of said lid, the portion of said U-shape structure disposed to the inside of said second arm in a direction closer to said first arm extending above the base of said U-shape structure to a substantial height sufficient to confine said rim within said formation during inward rotation of said handle of said tool, and the upwardly directed cutting edge of said tool is disposed on a cutting blade positioned across the aperture of said U-shape structure, whereby during inward rotation of the handle portion of said tool about said fulcrum, the cutting edge of said tool is caused to cut through the lip and to pass upwardly to locally sever the rim, a segment of the rim adjacent the cut being caused to pass beside the blade into a confined, gripped relationship with said formation, further rotation of said handle causing said formation to pull the rim portion contiguous with the gripped segment over a substantial arc upward and outward to facilitate removal of the lid.

3. The tool of claim 2 wherein said cutting edge is upwardly disposed across the aperture of said U-shape structure in a manner whereby during inward rotation of the handle of said tool, adjacent portions of said rim about the point of cutting are simultaneously gripped and adjacent contiguous portions of the rim over a substantial arc are pulled outward and upward by said tool.

4. The tool of claim 1 wherein said first arm lies at an obtuse angle to the shaft.

5. The tool of claim 4 wherein said angle is between about 120° and 160°.

6. The tool of claim 1 wherein said second arm is substantially colinear with said rigid shaft.

* * * * *